United States Patent [19]

Sleder et al.

[11] 3,937,200

[45] Feb. 10, 1976

[54] BREAKERLESS AND DISTRIBUTORLESS MULTIPLE CYLINDER IGNITION SYSTEM

[75] Inventors: Richard L. Sleder; Arthur O. Fitzner, both of Fond du Lac, Wis.

[73] Assignee: Brunswick Corporation, Skokie, Ill.

[22] Filed: July 18, 1973

[21] Appl. No.: 380,384

[52] U.S. Cl. ..... 123/148 CC
[51] Int. Cl.[2] ..... F02P 3/06
[58] Field of Search ..... 123/148 MC, 149

[56] References Cited

UNITED STATES PATENTS

| | | | |
|---|---|---|---|
| 2,980,822 | 4/1961 | Short | 123/148 E |
| 3,461,851 | 8/1969 | Stephens | 123/148 E |
| 3,542,007 | 11/1970 | Minks | 123/148 MC |
| 3,658,044 | 4/1972 | Safstrom | 123/148 E |
| 3,669,086 | 6/1972 | Beuk | 123/149 R |
| 3,678,913 | 7/1972 | Zimmermann et al. | 123/148 MC |
| 3,704,397 | 11/1972 | Crouch | 123/149 R |
| 3,723,809 | 3/1973 | Fujii | 123/148 MC |
| 3,782,353 | 1/1974 | Kammerer | 123/148 E |
| 3,809,041 | 5/1974 | Kato | 123/148 E |

*Primary Examiner*—Wendell E. Burns
*Assistant Examiner*—Joseph Cangelosi
*Attorney, Agent, or Firm*—Andrus, Sceales, Starke & Sawall

[57] ABSTRACT

A two cylinder, two cycle engine for an outboard motor includes an alternator driven, capacitor discharge ignition system. The alternator includes an annular permanent magnet secured within a flywheel skirt and includes a pair of circumferential opposite poles with diametrical spaced neutral areas. The magnet is a flexible ferrite strip with a butt joint at one of the neutral areas. A stator assembly is mounted within the annular rotor and includes a semicircular core with a charging coil at each end. Each movement of the magnetic gap means past the coils generates a pulse. A trigger coil within a housing is mounted in coplanar relation between the charging coils, with a pole aligned with and spaced from the stator core. The housing is rotatably mounted and includes an integral cam for positioning a throttle lever. A pair of capacitors are connected in parallel to the charging coils through steering diodes such that the one capacitor is charged from one of the polarity pulses while the other capacitor is charged from opposite polarity pulses. A common gated controlled rectifier is connected in a discharge path for both of the capacitors through individual pulse transformers and isolating diodes. Only the charged capacitor provides energy through its pulse transformer. A full wave rectifier rectifies each trigger pulse and is connected by a trigger circuit to the gate of the controlled rectifier.

12 Claims, 9 Drawing Figures

Fig. 1
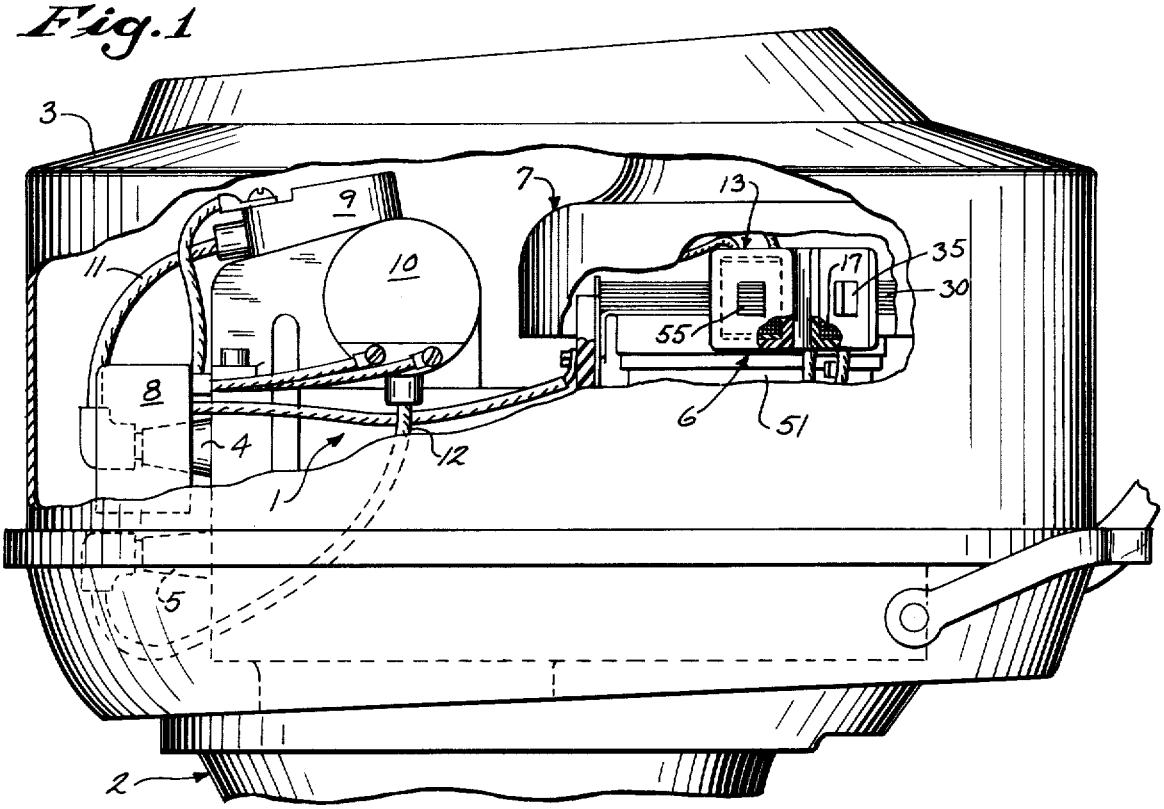
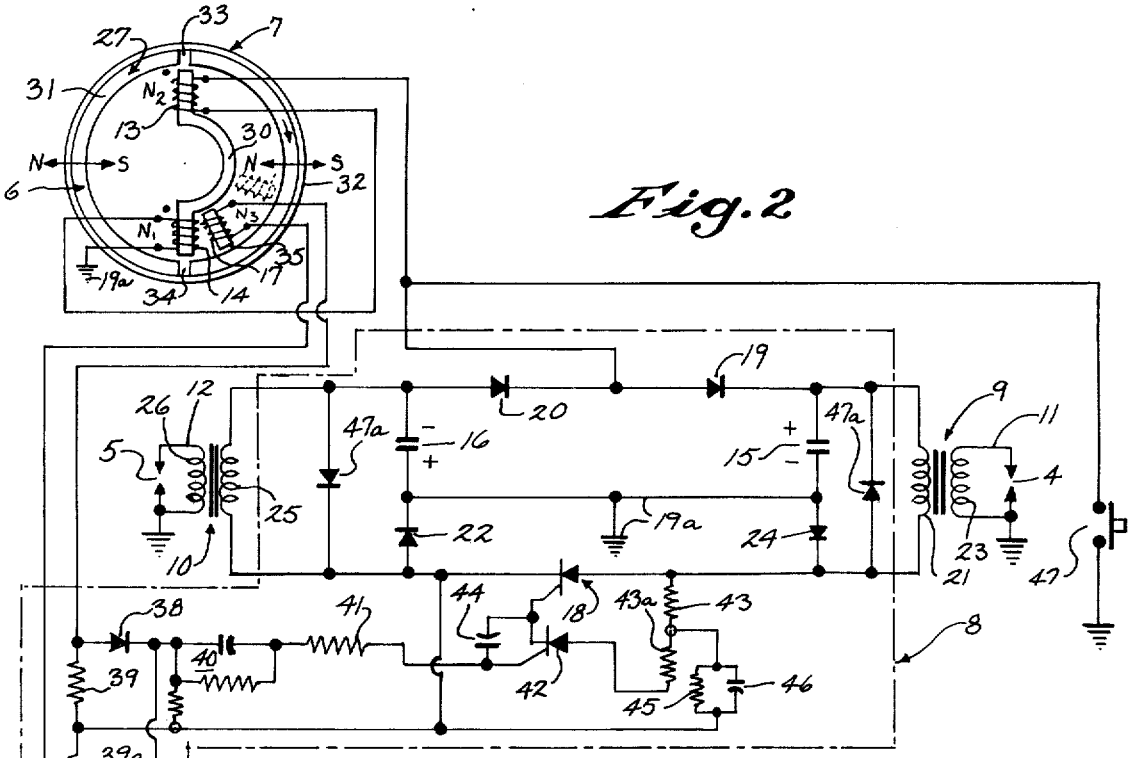
Fig. 2
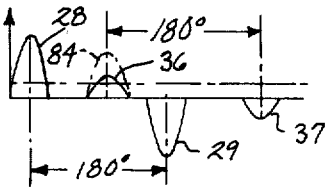
Fig. 3

Fig.4
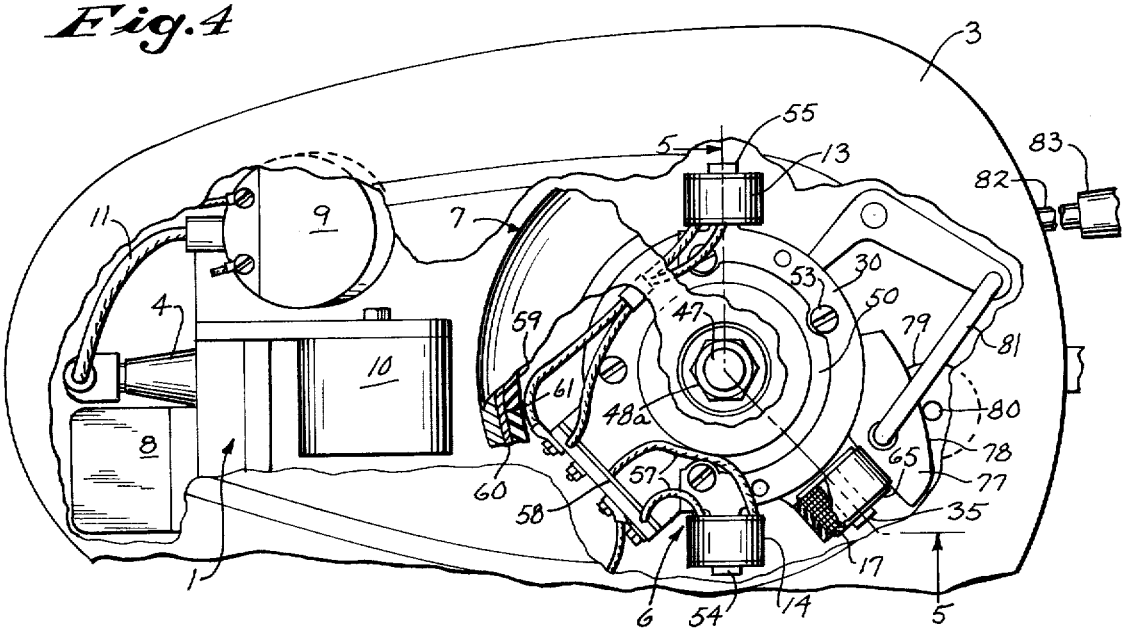
Fig.6
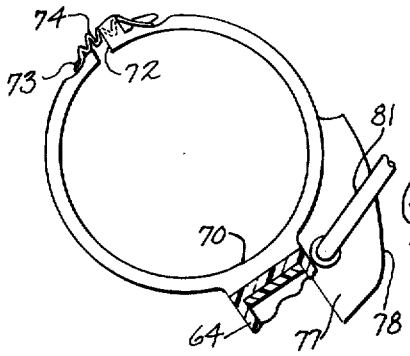
Fig.7
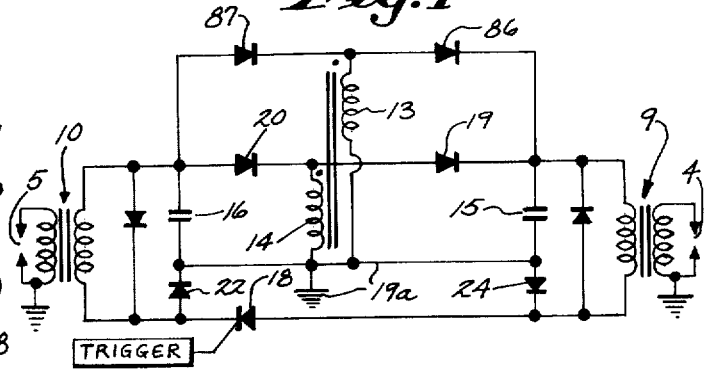
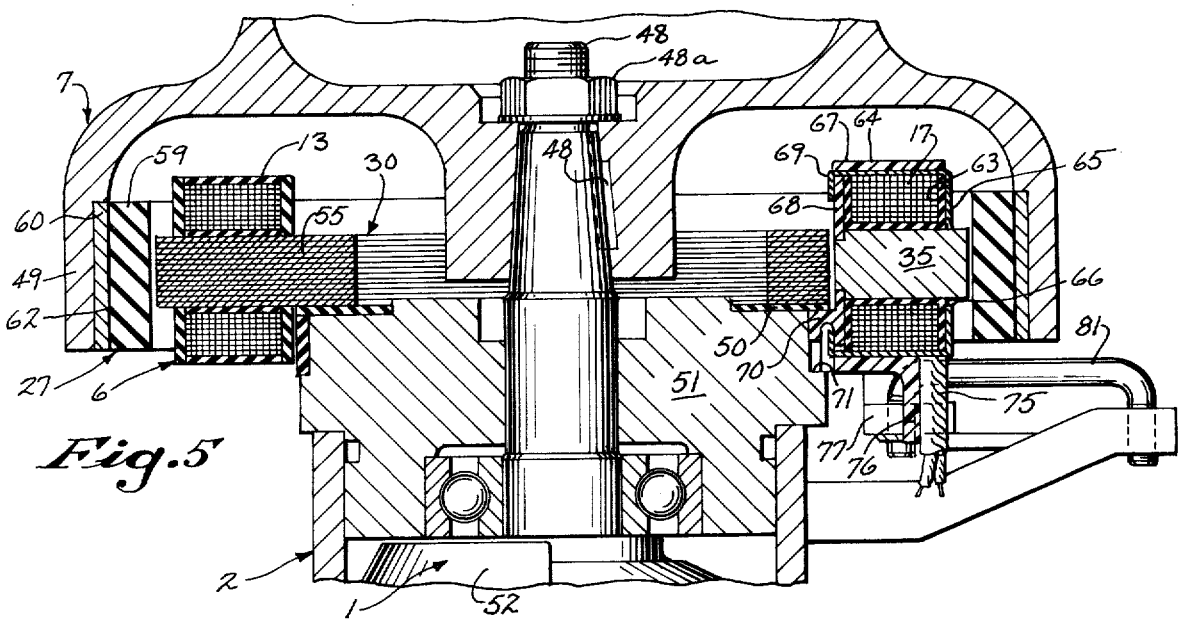
Fig.5

BREAKERLESS AND DISTRIBUTORLESS MULTIPLE CYLINDER IGNITION SYSTEM

BACKGROUND OF THE INVENTION

This invention relates to a breakerless and distributorless multiple cylinder ignition system and particularly to an alternator driven ignition system adapted for multiple cylinder two cycle motors and the like.

The advances in the technology of solid state devices and alternator constructions has resulted in the development of alternator driven capacitor discharge ignition systems.

In capacitor discharge systems, a main firing capacitor is charged to a relatively high voltage level and then rapidly discharged, by actuation of a solid state switch such as a controlled rectifier, through suitable pulse transformer to generate and transmit the firing energy to a selected spark plug. The capacitor may be charged from a battery power supply through a DC to DC converter. Alternatively, and, in particular, for relatively small engines such as in low horsepower outboard motors, an alternator is advantageously employed to produce an alternating current output which is rectified and applied to charge the capacitor. A trigger generator signal means preferably forms a part of the alternator unit to produce a signal for proper timed activation of the solid state switch to discharge the capacitor. A distributor may be employed to distribute the energy to anyone of a plurality of cylinders in a multiple cylinder engine, or alternatively separate coupling circuits may be provided with steering means to selectively transfer the energy to the several discharge circuits. Thus, the conventional rotating distributor is, in essence, replaced with an electronic steering and power distributing circuit. For example, the U.S. Pat. No. 3,612,948 discloses an alternator driven capacitor discharge ignition system wherein a common capacitor is selectively coupled through individual solid state switches to individual pulse forming and firing circuits to the several spark plugs of a dual or two cylinder engine. A charging alternator is provided to charge the capacitor and a separate triggering alternator is provided to fire the switches in predetermined timed relation for accurate and proper discharge of the capacitor through the several circuits. An alternative system employing an alternator having a single magnetic rotor and, a plurality of windings wound on a common stator is shown in U.S. Pat. No. 3,358,665.

In ignition systems, means are advantageously provided to vary the ignition timing of the engine by varying the relative time of generating the firing pulse. Thus, the engine is normally started with a retard firing, that is, with the firing occurring slightly after a piston reaches top dead center position. As the speed increases, the time of firing is preferably advanced from said top dead center position. Various electronic circuits as well as mechanical leverage systems have been suggested to produce a controlled advance. For example, U.S. Pat. No. 2,906,251 discloses a cam arrangement interconnected through a throttle unit for providing an interrelationship between the firing of a breaker-point system and the throttle setting.

When applied to relatively small engines such as a two cylinder engine for an outboard motor, the overall size of the mechanical construction also becomes somewhat more significant. From an aesthetic standpoint, the overall height of the engine and thereby the power head for low HP motors is preferably minimized. As the alternators are normally incorporated into the flywheel structure, the design preferably minimizes the vertical space requirements so as to permit lowering of the flywheel to a maximum thereby maintaining the desired lower profile. The construction, of course, must not however sacrifice the alternator output such that it falls below the level required for reliable and satisfactory ignition as well as providing means to maintain proper timing.

Further in all such ignition systems, the cost of both the initial construction and subsequent maintenance from a mechanical and electrical standpoint must be and is of substantial practical significance and consideration.

SUMMARY OF THE PRESENT INVENTION

The present invention is particularly directed to an improved ignition system employing an alternator driver for providing stored energy and subsequent transfer of such stored energy through a breakerless and distributorless ignition system. Generally, in accordance with the present invention a plurality of individual capacitors are provided one for each of the cylinders. An alternator means selectively charges the capacitor and actuates a common switch means for selectively discharging of the capacitors. The alternator means preferably includes an integrated trigger signal stator means which is physically mounted for movement relative to the related alternator rotor means to permit adjustment of the timing by changing of the actuation point or time of the common switch means with respect to the engine crankshaft and piston position.

More particularly, in accordance with a very significant and important feature of the present invention, charging and triggering means such as circumferentially special coil means are activated from a common magnetic system coupled to the engine crankshaft. The charging and triggering means are sequentially and alternately coupled to a magnetic means to provide for sequential timed spaced activation of the charging means and the trigger means.

In a preferred alternator construction in accordance with the present invention, the charging coil means and the trigger coil means are formed as a relatively plate-like coplanar unit which is mounted in fixed relation about the engine crankshaft, or a shaft driven in synchronism therewith. The rotor is secured to such shaft and includes an annular coplanar magnetic means such that the rotation thereof provides sequential coupling of the magnetic means to the charging coil means and to the trigger coil means.

In a particularly satisfactory system for a two cylinder engine for an outboard motor, and the like, a pair of oppositely disposed charging coils are provided and interconnected to provide conjoint and simultaneous charging of the capacitors. A trigger coil is located between the two charging coils. The magnet means is secured to the flywheel and includes a pair of opposite polarity, circumferential poles with end gaps such that the output of the windings alternately varies in synchronism with the coupling to the gaps. The magnet is advantageously formed of a flexible ferrite strip mounted within the flywheel with a butt joint at one of the gaps. A pair of capacitors are connected in parallel to the charging windings through suitable steering diodes such that the one capacitor is charged from the one polarity pulse while the other capacitor is charged from the opposite polarity pulse. Thus, during each movement of the magnetic gap means past the coil means, a single one of the capacitors is charged. A common control switch such as a silicon controlled rectifier is connected in a discharge path for both of the capacitors through the individual pulse transformers. Although the switch completes both discharge circuits each time it is actuated, only one of the capacitors has been charged and consequently only one of the capacitors will provide energy through its firing circuit. A pulse transformer is preferably connected across each of the capacitors in series with a steering or blocking diode, with the common switch means connected between the windings and the diode connection. Thus, when the common switch is turned on the capacitors can discharge through the series connection of a pulse transformer, diode, and the switch means.

The common switch means is suitably activated from the trigger coil means. Since the trigger coil means generates alternate polarity voltage pulses, the trigger circuit perferably includes a full wave rectifier whose output is coupled to trigger the common switch means, preferably through a second control rectifier. The trigger circuit also preferably includes a resistor capacitor network which is charged to a voltage level that is essentially proportional to engine speed and connected into the circuit to maintain a stabilized triggering point which is not affected by the change in the rate of rise of the trigger voltage pulse.

In accordance with a further novel aspect and feature of the present invention, the trigger coil means of the capacitor discharge ignition system is mounted in a movable support means for angular orientation about the shaft and, in one embodiment, relative to the charging coil means. The support means is coupled to the engine throttle control for corresponding positioning. In one construction, a cam member is formed on the support means and coupled through the throttle control mechanism to provide corresponding timed positioning of the trigger coil means. A cam follower is connected to the engine throttle mechanism to thereby provide a predetermined interrelationship as a result of the preselected formation of the cam. The throttle control is thus coupled to directly position the cam and simultaneously provide the desired setting of the trigger coil means for discharging of the capacitor with the desired timing. The timing is, thus automatically and positively correspondingly selected to maintain very accurate and interrelated positioning of the triggering signal means.

The present invention thus provides a highly improved alternator driven capacitor discharge ignition system particularly adapted for two cycle engines such as employed in outboard motors.

BRIEF DESCRIPTION OF THE DRAWINGS

The drawings furnished herewith illustrate preferred constructions of the present invention in which the above advantages and features are clearly disclosed as well as others which will be readily understood from the following description, of the illustrated embodiment.

In the drawings:

FIG. 1 is a side elevational fragmentary view of an outboard motor with parts broken away to illustrate the construction of an alternator;

FIG. 2 is a schematic circuit diagram of an ignition system employing the alternator shown in FIG. 1;

FIG. 3 is a graphical illustration of the open circuit voltage output of the alternator unit;

FIG. 4 is a top view of FIG. 1 with parts broken away and sectioned to more clearly show details of construction;

FIG. 5 is a horizontal sectional view taken generally on line 5—5 of FIG. 4 to more clearly illustrate details of the system; and FIG. 6 is a plan view of an integral housing and mounting ring, shown in FIGS. 4 and 5, for the trigger coil means; and FIG. 7 illustrates an alternate circuit and;

DESCRIPTION OF THE ILLUSTRATED EMBODIMENT

Figure 9:
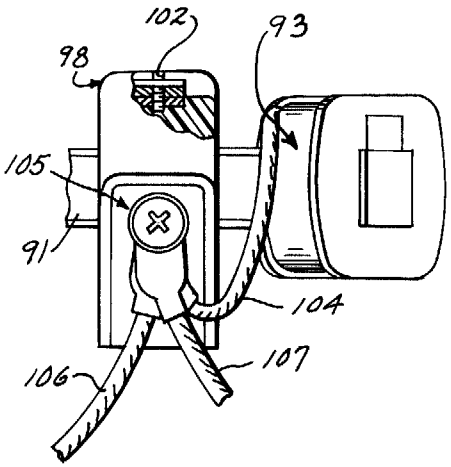
FIGS. 8 and 9 illustrate an alternate coil termination.

Referring to the drawings and particularly to FIG. 1 a fragmentary portion of an outboard motor is shown having an internal combustion engine 1 mounted on a lower drive shaft unit 2 and enclosed within a suitable protective and decorative cowling or housing 3. The engine 1 is of any suitable construction and is preferably the usual two cycle, internal combustion engine widely employed in the outboard motor industry. The engine 1 is connected through any suitable means to a propeller drive mechanism, not shown, at the lower end of the unit 2.

The engine is illustrated as a two cylinder engine 1 having a pair of in-line cylinders with individual spark plugs 4 and 5. The engine 1 is typically employed in the lower horsepower outboard motors. The two cylinder engine is shown to clearly illustrate a preferred embodiment of the present invention which is more particularly directed to the construction of an alternator-driven capacitor-discharge ignition system for firing of the engine. Consequently, no further detailed description of the engine or outboard motor is given other than that which is necessary to clearly describe the construction and operation of the new and novel alternator driven ignition system for providing of power to the engine spark plugs.

Generally, in FIG. 1, an improved alternator unit 6 constructed in accordance with the present invention is mounted directly within the flywheel assembly 7 of the engine 1 and connected to a capacitor discharge ignition box 8, the output of which is connected via a pair of coils or pulse transformers 9 and 10 to ignition wires 11 and 12. The ignition output thereby sequentially and alternately fires the spark plugs 4 and 5 of the engine 1, and thereby provide continued and proper engine operation.

A preferred schematic circuit of the alternator unit 6 and the associated capacitor discharge ignition system is shown in FIG. 2 which will be described before the detailed description of the preferred physical construction and features of the alternator unit 6.

Thus, referring particularly to FIG. 2, the alternator unit 6 includes a pair of charging windings 13 and 14 which are connected in series additive with each other and connected through charging circuitry to selectively charge a first capacitor 15 associated with the spark plug 4 and a second capacitor 16 associated with the second spark plug 5. The alternator unit 6 further includes a triggering winding 17, which is connected to control a common discharge switch 18 for sequentially discharging of the capacitors 15 and 16 in timed spaced relation to produce alternate firing of the spark plugs 4 and 5.

More particularly, in the illustrated embodiment of the invention, the charging windings 13 and 14 are connected in a series additive circuit to charge capacitors 15 and 16.

Capacitor 15 is connected in series with a diode 19 directly across the two windings 13 and 14 with the negative end of the capacitor 15 connected through a common ground 19*a* to the one end of the series connected windings. The second capacitor 16 is similarly connected directly across the windings 13 and 14 in series with an oppositely polarized diode 20.

Consequently, by producing of alternate polarity pulses or signals in the windings 13 and 14, the capacitor 15 is charged by the one-half cycle or signal having the one polarity, diagrammatically shown by the polarity dots in FIG. 2. The capacitor 16 is charged with the opposite polarity pulses.

The discharge of the capacitors 15 and 16 to fire the respective spark plugs 4 and 5 is provided through similar circuits as follows.

The capacitor 15 has its positive plate connected directly to the one side of the primary winding 21 of the pulse transformer 9. The opposite side of the primary winding 21 is connected in series with the control switch means 18 shown as a silicon controlled rectifier and a steering diode 22 to the common ground return 19*a* and thus to the opposite or negative plate of the capacitor 15. The diode 22 is polarized to conduct in the same direction as the controlled rectifier 18 and is there-polarized to discharge the capacitor 15 through transformer 9 when the common switch means 18 is conductive or turned on. The secondary winding 23 of the transformer 9 is connected directly across the spark plug 4 and fires the corresponding cylinder whenever the capacitor 15 discharged through the transformer.

The capacitor 16 is similarly connected in an alternate circuit and in particular has its positive plate connected to the common ground 19*a*. A diode 24 connects the common ground to the anode side of the controlled rectifier 18 the cathode of which is connected to one side of the primary winding 25 of the second pulse transformer 10. The opposite side of the primary winding 25 of transformer 10 is connected to the negative plate of the capacitor 16. Thus when the controlled rectifier 18 is turned on, a discharge path is also created for the capacitor 16 through the corresponding polarized diode 24, the conducting control switch 18 and the transformer 10. The secondary winding 26 of transformer 10 is connected directly across the spark plug 5 and provides for firing of the corresponding cylinder.

The diode 22 is of course connected directly between the capacitor 16 and the one side of primary winding 25 of the transformer 10. However, the polarization of diode 22 is in a non-conductive or block state with respect to the capacitor 16, which now can only discharge through the diode 24. Similarly, the diode 24 is reversed connected with respect to the capacitor 15.

Thus by providing a magnet means 27 which is periodically coupled to the windings 13 and 14 to provide timed spaced pulses of opposite polarity, such as shown at 28 and 29 in FIG. 3, the capacitors 15 and 16 are alternately charged. As diagrammatically shown in FIG. 2, the coils or windings 13 and 14 are wound on a stator core 30 located within the engine flywheel 7. The windings 13 and 14 are located 180 degrees apart. The magnet means 27 includes a pair of circumferential, opposite polarity poles 31 and 32. Each pole spans essentially 180 degrees to define a pair of diametrical opposite zero flux or neutral polarity points, shown by gaps 33 and 34 between the circumferential ends of the poles. Thus as each gap 33 or 34 moves past a winding 13 or 14, the magnetic polarity applied to the winding reverses and the flux change generates an appropriate pulse 28 or 29 in the corresponding windings. Thus the windings 13 and 14 are so wound that with the opposite gaps aligned with the windings as shown in FIG. 2 the same polarity pulse such as pulse 28 is generated. When the flywheel rotates 180 degrees, the gaps 33 and 34 are reversely aligned and generate the opposite polarity pulse 29 in both windings 13 and 14. The winding 17 is wound upon a movable pole 35 forming a part of the stator unit 30. The winding 17 is located intermediate the two coils 13 and 14 for coupling to the same magnetic driving polarity reverse gaps 33 and 34. The polarity of the pulse reverses with each gap, and thus opposite polarity pulses 36 and 37 are generated as shown in FIG. 3, during each complete revolution of the flywheel 7.

Between each charging period, the trigger winding 17 is therefore also coupled to magnetic mean 27 and particular one of the gaps 33 or 34. The output of winding 17 activates or turns on the control switch 18, thereby providing discharge of the previously charged capacitor 15 or 16.

The controlled rectifier 18 provides a very rapid completion of the discharge circuit, and the diodes 22 and 24 in the discharge path provide a very low impedance such that the previously charged capacitor 15 or 16 discharges very rapidly. There is, therefore, only a minimal tendency for the discharge current to also pass through the parallel path provided by the opposite transformer and capacitor.

As the opposite capacitor 15 or 16 has not yet been charged, the simultaneous completion of its discharge circuit is inoperative so far as the corresponding transformer is concerned. The common switch means 18 is controlled from the common trigger coil means 17, the output of which is also an alternating current output as follows. The pulse 36 or 37 are full wave rectified through a pair of back-to-back rectifying diodes 38 and 38*a* connected across a pair of series connected resistors 39 and 39*a* and winding 17. The direct current trigger signal is generated between the common junctions of the diodes 38 – 38*a* and resistors 39 – 39*a*, similar to a central tapped trigger winding connection. The trigger signal is formed in intermediate timed spaced relationship to the main firing capacitor charging pulses 28 and 29. The output of the resistor-rectifier network is connected to actuate rectifier 18 through a series coupling circuit including a stabilizing paralleled resistor capacitor network 40, a current limiting resistor 41 and a cascaded secondary control rectifier 42. The rectifier 42 has its anode to cathode junction connected between the anode to gate junction of rectifier 18 in series with a pair of resistors 43 and 43*a*. The gate of rectifier 42 is connected to the resistor 41. A capacitor 44 also connects the gate to the cathode of rectifier 42. A paralleled resistor 45 and capacitor 46 is connected between the junction of the resistors 43 and 43*a* and the cathode of rectifier 18. The resistor 43 and resistor 45 form a voltage divider connected across switch 18 and thus in a series charging path with the charging windings 13 and 14. The capacitor 46 is, therefore, charged simultaneously with the charging of capacitor 15 and with the alternate charging of capacitor 16. The capacitor 46 is discharged through resistor 43*a* and controlled rectifier 42 to rapidly drive rectifier 18 into conduction, as presently described.

Thus, the following sequence describes the circuit response as the flywheel assembly and particularly the magnet assembly 27 rotates through one revolution with the neutral zones 33 and 34 first traversing the coils 13 and 14.

The magnetic flux in coils 13 and 14 is assumed to be such as to generate a relative positive voltage with respect to engine ground. The capacitor 15 therefor charges through diode 19 to a positive voltage relative to engine ground. Rectifier 18 is in the off state so that capacitor 46 also charges through the primary winding of 21 and diode 22 to a voltage level and at a rate determined by the resistance divider of resistors 43 and 45.

As the flywheel 7 and assembly 27 continuously rotates, a flux transition occurs in the trigger assembly core 35 as a neutral area 33 or 34 passes and generates a voltage pulse in winding 17. The polarity of this voltage pulse is immaterial as one of the two diodes 38 or 38*a* will be forward biased and conduct the pulse. Current will flow through the forward biased diode 38, the parallel combination of resistor and capacitor 40, resistor 41, the parallel combination of the gate to cathode junction of controlled rectifier 42 and capacitor 44, the gate to cathode junction of controlled rectifier 18 and resistor 39. This current is of sufficient magnitude to turn on controlled rectifier 42 but not controlled rectifier 18. Controlled rectifier 42 is forward biased by the voltage on capacitor 46, which will discharge through resistor 43*a*, the anode to cathode junction of controlled rectifier 42, and the gate to cathode junction of controlled rectifier 18. Capacitor 46 and resistor 43*a* are selected such that the current discharge pulse is ideal for the turn on of controlled rectifier 18 under high di/dt conditions. Controlled rectifier 18, therefore, turns on hard and the main firing capacitor 15 will discharge through the primary winding 21 of ignition coil 9, through the anode to cathode junction of controlled rectifier 18, and diode 22. This discharge is a short duration, very high amplitude current pulse and causes a fast rising voltage to appear in the secondary winding of 23 of ignition coil 9 of sufficient amplitude to ionize the spark plug gap 4 and provide ignition in the corresponding cylinder. Controlled rectifier 18 will stay in conduction until the anode to cathode current falls below the device holding current.

As the flywheel 7 and assembly 27 continues in rotation, rectifier 18 turns off and a reverse flux transition again occurs in the stator poles for coils 13 and 14. This transition is in the opposite direction and 180 crankshaft degrees later relative to the first transition. An opposite voltage is therefore generated by the series additive coils 13 and 14 which is negative with respect to engine ground. The second main firing capacitor 16 will then charge through diode 20 to a negative voltage relative to ground. Main control rectifier 18 is in the off state so that capacitor 46 also charges through rectifier 24 and the primary winding 25 of coil 10. As before, capacitor 46 charges to a voltage level and at a rate determined by the resistance divider of resistors 43 and 45.

As the flywheel 7 continues still further in rotation a second flux transition occurs in the trigger assembly core 35 and coil 17. This transition is in the opposite direction and 180 crankshaft degrees later relative to the first transition. Coil 17 will therefore generate a voltage pulse of opposite polarity relative to the first voltage generation. A trigger current again flows as previously described with the exception that the flow will be through opposite diodes 38*a* and resistor 39*a*. This trigger signal functions in the same manner to turn on controlled rectifier 42 such that capacitor 46 will discharge as previously described turning on controlled rectifier 18. Capacitor 16 will then discharge through diode 24, the anode to cathode junction of controlled rectifier 18, and the primary winding 25 of ignition coil 10. As previously described, a fast rising voltage pulse appears in the secondary 26 and ignition then occurs in the second cylinder.

As the flywheel 7 and assembly 27 continues its rotation, controlled rectifier 18 again turns off, one revolution is completed, and the above sequence is repeated for each subsequent revolution.

The paralleled resistor-capacitor network 40 produces a voltage which is generally proportional to the engine speed. The source for this voltage is the trigger voltage pulses generated by coil 17. The capacitor voltage thus introduces a back bias in the trigger network such that the effective or operative trigger voltage level required from the trigger winding to fire the controlled rectifier increases with speed and becomes stabilized for all engine speeds. This also increases the actual trigger level to thereby reduce the danger of the control rectifier being fired from undesired spurious voltage signals which may arise as a result of other close proximity ignition systems as well as other high frequency devices in the surrounding environment, or alternator noise generation.

Further, manually operable kill switch 47 is shown connected directly across the windings 13 and 14. When the switch 47 is closed, the direct conductive path established across the windings prevents charging of either one of the capacitors and thereby prevents the application of the capacitor signals through the respective transformers or coils 9 and 10. The kill switch means can be otherwise located, for example, across switch 18. In that instance the output of alternator windings 13 and 14 can flow through the transformers 9 and 10 directly, but the energy in the signals are not of a nature sufficient to fire the engine. Suitable stabilizing diodes 47*a* are also preferably connected across the primary windings in 21 and 25 in accordance with conventional design practice.

With switch 47 open, the system operates continuously to properly fire the engine by the proper opposite and sequential activation of the charging coil means 13 – 14 with the intermediate activation of the trigger coil means 17. In particular, the alternator generates the opposite polarity charging pulses 28 and 29 and the intermediate and interspersed trigger pulses 36 and 37.

A preferred, novel alternator, as diagrammatically shown in FIG. 2 is more particularly shown in FIGS. 1, 3, 4 and 5. The alternator unit 6 is connected directly as an integrated part of the engine's flywheel 7 which, in turn, is secured to the upper end of the engine's crankshaft 48. The flywheel 7 is a generally inverted cup-shaped member having a control hub keyed to the crankshaft 48 and locked in place by a clamping nut 48*a*.

The alternator unit 6 includes a permanent magnetic rotor assembly 27 connected as an integrated part into the depending skirt 49 of the flywheel 7. The rotor assembly 27 rotates with respect to the stator unit 30 which is mounted concentrically of the crankshaft 48 within the flywheel 7. The stator unit 30 supports the three windings 13, 14 and 17 in a circumferentially spaced relation in a common plane within the magnetic rotor assembly.

Referring particularly to FIGS. 4 and 5, the illustrated stator unit 30 includes a stator mounting means in the form of a plate 50 which is shown attached to an annular plate or end cap 51 on the top of the engine block 52 with the crankshaft 48 projecting upwardly there through. A generally semicircular magnetic core 30 is formed as a laminated member and is riveted to the plate 50 and the mounting means is bolted or otherwise secured to the end cap 51 as at 53. The opposite ends of the laminated iron core 30 includes two radially projecting pieces 54 and 55 located essentially 180° apart. The pole pieces 54 and 55 terminate in relatively slightly curved or flat end faces similarly located outwardly of the supporting stator plate on a common radius with respect to the crankshaft 48. The first and second charging coils 13 and 14 are wound on suitable insulating bobbins 56 and secured one each on the respective poles. The coil leads 57 are connected in circuit via a terminal board 58 to the ignition switch box 8. The terminal board 58 is suitably attached to the stator support plate 50 on the opposite side from the core 30. The ignition circuitry such as shown in FIG. 2 is housed within the ignition box 8 as a potted unit, with the output connected as the input to the respective pulse transformers 9 and 10 which are suitably mounted upon the engine 1 and particularly adjacent the backside thereof to minimize the length of the spark plug leads 11 and 12.

The rotor assembly 27 has the annular magnet unit including the oppositely polarized permanent magnets 31 and 32 secured within the inner periphery of the flywheel skirt 49 and in the plane of the laminated core 30 and particularly the pole pieces 54 and 55.

In a preferred construction as illustrated, the magnets 31 and 32 are formed from a flexible, rubber-like ferrite member 59 which is secured within an annular magnetic iron ring 60 which serves as a return path for the magnetic flux. The member 59 is an elongated strip having a single butt joint 61 at the adjacent opposite ends. The strip is securely attached to the ring as by a suitable adhesive 62 and is then polarized in diametrically opposite belts to form magnets 31 and 32. The polarization is at 90° to the diameter through the butt joint 61, which is therefore located at one of the opposite effectively zero or neutral zones lying on a diameter which is normal to that through the polarized belts. If desired, separate elements with physical air or other non-magnetic gaps such as shown in FIG. 2 may of course be used. The rotation of the flywheel 7 and attached rotor results in the sequential movement of the neutral zones 33 and 34 of FIG. 2 past the similarly spaced coils 13 and 14 to provide charging pulses as previously described.

The trigger coil 17 is specially mounted on a circumferentially movable pole 35 which is generally located intermediate the two charging coils 13 and 14 and in a common plane therewith. The particular timing of the ignition is determined by the circumferential spacing and location of the trigger coil with respect to the charging coils. As a result, the trigger coil is coupled to a neutral zone after each coupling between the neutral zones and the charging windings to thus produce the discharge or trigger signal before the charging windings are again coupled to the neutral zones.

More particularly, the trigger coil 17 is wound within an insulating bobbin 63 and encircles pole 35 which can be formed as a sintered iron member or in any other suitable manner. The coil 17 and pole 35 are mounted within a plastic trigger housing 64 which is rotatably mounted to the end cap 51. The coil, pole and bobbin assembly is locked within the housing 64 by a small U-shaped retaining clip 65 having a base opening 66 which fits over the outer projecting portion of the core or pole 35. The sidewalls of the clip 65 extend laterally over the coil 17 within the housing 64 provided in the back wall 68 of the housing 64. The outermost ends of the clip 65 are bent over as at 69 to securely fasten or secure the coil assembly within the housing. Magnetic pole 35 extends radially through housing 64 with the inner end aligned with and very slightly spaced from the laminated charging coil core 30. The outer end or face of pole 35 is similarly spaced from the magnet member 59.

The housing 64 includes an integrally formed mounting ring 70 having an inner diameter generally corresponding to a mounting diameter peripheral ledge 71 provided on the end cap 51 immediately beneath the stator core plate 50. The ring member 70 is releasably and rotatably clamped within the ledge 71. The illustrated member 70 is split, as at 72 diametrically opposite from the housing 64. The opposite split ends are formed as hook portions or members 73. A connecting spring 74 is looped over the hook portions 73 to resiliently and firmly attach the plastic ring 70 and attached housing 64 to the end cap. The spring member permits sliding angular positioning of the interconnected housing 64 for varying the position of the iron core 35 and coil 17 with respect to the relatively fixed position of the charging coils 13 and 14 and more particularly with respect to the position of the crankshaft 47 and interconnected neutral zones 33 and 34 of magnet ring 59. The crankshaft and zones 33 and 34, in turn, are directly related to the relative position of the piston units within the engine cylinders such that the mechanical positioning of the coil 17 establishes a relative retard or advance trigger signal to provide a desired ignition timing change. The split ring mounting may of course be replaced with a suitable solid ring or the like with a controlled fit and mounting to permit the desired angular positioning.

The circuit connecting cable 75 to the coil 17 extends downwardly from the lower wall of the housing 64 and is secured to a depending plate portion 76. The cable 75 leads from the trigger box 8 are terminated at the terminal block to provide the appropriate signal to the control rectifier 18 or other switch means.

The housing 64 and ring 70 accurately locate the trigger pole 35 with respect to the laminated U-shaped core 30 and the annular magnet member 59. Thus, the air gaps can be held to a minimum with efficient coupling to coil 17.

In the illustrated embodiment of the invention, both the trigger and charging coils are maintained in substantially a coplanar relationship which permits minimizing of the height of the outer cowl 3 and thereby contributes to the low profile desired in outboard motors and the like.

In addition, a timing cam plate 77 is shown integrally formed on the outer periphery of the trigger retaining a horizontal plate member. The edge 78 of the cam plate 77 curves rearwardly and inwardly to the ring portion 70. The throttle lever for the carburator 79 has a cam follower 80 riding on the cam edge 78 and connected to control the throttle position. This provides a continuously related throttle setting in direct relationship to the generation of the pulse signal by coil 17 and produces a related discharging of a capacitor 15 or 16 to maintain optimum operation thereof.

The timing cam plate 77 is connected through a suitable linkage 81 to a throttle control lever 82. For small two cylinder engines, a manually rotated handle 83 may be provided and coupled through suitable gearing mechanism to rotate the control lever 82 and thus provide a desired timing and throttle control. The trigger coil 17 is movable between a retard position and an advance position, as shown in phantom in FIG. 2. The peak of the signals in the trigger coil 17 is spaced from the peak of the signal generated in the charging coils 13 and 14 by the angle between the coils, as shown. This angle is, of course, adjustable between the illustrated retard angle and any predesigned maximum advance angle. In actual construction, a maximum advance of 36° (before dead center) and a retard of approximate 13° (after top dead center) was employed.

The operation of the preferred embodiment of the invention, as shown in FIGS. 1 – 6, is summarized as follows, with reference to FIGS. 2 and 3.

As the magnet member 59 rotates, the first flux change illustrated is assumed to provide the polarity illustrated in FIG. 2. The voltages generated in the coils 13 – 14, as a result of the winding direction, charges the capacitor 15 via diode 19. The neutral pole position 33 in FIG. 2 moves past the trigger coil 17. The polarity of this signal is full wave rectified so either pulse 36 or 37 provides a corresponding trigger signal to trigger the control rectifier 42 and discharge capacitor 46 to fire the main controlled rectifier 18, in accordance with the previous circuit description.

Capacitor 15 will discharge through the transformer 9, the conducting rectifier 18 and diode 22 and will rapidly, completely discharge the stored energy such that the rectifier 18 resets to the blocking state before the gap 33 is again aligned with charging coils 14. The discharging of the capacitor 15, of course, results in a rapidly rising voltage in the secondary 23 of the transformer 9, resulting in breakdown and ionization of the plug 4 with proper ignition.

As the speed increases the trigger pulse signal rises more rapidly such as shown by superimposed pulse signal 84 of FIG. 3. This would tend to fire the controlled rectifier 18 sooner than the time of the slower speed pulse 36. However, the bias of capacitor 40 opposes the trigger pulse and at higher speeds increases such that an essentially constant pulse time is provided for any given angular orientation or setting of coil 17.

The next flux reversal presented by the gaps 33 and 34 to the charging coils 13 and 14 generates the opposite polarity signals 29 to charge the capacitor 16 through the diode 20. The second gap 34 is then presented to the trigger coil 17 and the opposite polarity signal 37 is generated. As a result of the full wave rectification, the signal 37 again provides for cascaded firing of the controlled rectifiers 42 and 18 to discharge the capacitor 16 through the diode 24, the controlled rectifier 18 and the primary 25 of the second ignition coil 10. The discharging of the capacitor 16 similarly generates a rapidly rising voltage in the secondary 26 which is applied to fire spark plug 5 and thereby provide proper ignition in the corresponding cylinder. This returns the circuit to the condition illustrated which corresponds to the beginning of the next revolution. Thus two ignition pulses are obtained 180° apart in each revolution of the crankshaft 47. The precise point of ignition is determined by the mechanical setting of the trigger coil 17. Thus, as the throttle control 83 is positioned, to accelerate the engine 1, the trigger coil 17 rotates to an advance position, simultaneously with the interconnected cam 77 operating the throttle 80. The charging pulses 28 and 29 are not sharp distinct signals as illustrated because of the inductive and capacitive characteristics of the circuit. Rather, they extend substantially over the peak position and may provide charging energy during the complete period.

It will be noted, however, that as the advance position is established with increasing speed, there is a shorter time period between the coupling of the gaps 33 and 34 with the charging coils 13 and 14 and the coupling to the trigger coil 17. There is thus a reduced time period during which to charge the capacitors. However, even though the capacitors 15 and 16 may be charged to a lesser level, internal combustion engines generally require less voltage to properly fire the spark plugs at higher engine speeds. Thus, the net voltage developed across the capacitors 15 and 16 is related to the demands of the spark plugs over the normal operating speed range of the engine 1 such as used in the lower horsepower outboard motors.

Further, if desired a relatively flat capacitor voltage level can be obtained by mounting of the trigger coil in fixed relationship to the charging coils to maintain a corresponding maximum constant charging time. In order to provide proper advance, the total stator assembly is then rotated to produce the desired ignition timing. This is not as desirable from a physical construction standpoint, and, as noted above, Applicants have found that the illustrated construction provides a reliable and satisfactory system.

Another method which may be used is to have the windings 13 and 14 especially wound with different turns to provide high and low speed windings, such as disclosed in U.S. Pat. No. 3,542,007. The output of the one winding would produce a high output at low speeds and a low output at high speeds while the second winding would produce a high output at high speeds and a low output at low speeds. The charging circuits for the capacitors 15 and 16 would also provide a parallel connection of the windings 13 and 14 to the respective capacitors 15 and 16, for example, as shown in FIG. 7. As the circuit connections remain basically similar, only the changed portion of the circuit is shown in FIG. 7 and corresponding elements are similarly numbered for purposes of simplicity and clarity of explanation.

In FIG. 7, windings 13 and 14 are connected parallel additive or aiding, with one end of each winding connected to common ground 19*a*. Winding 14 is connected to capacitor 15 through diode 19 and to capacitor 16 through diode 20. Diodes 86 and 87 are added to connect winding 13 to capacitors 15 and 16 in a similar manner. Capacitor 15 will charge when windings 13 and 14 generate a positive voltage relative to ground 19*a* as previously described. The advantage of this construction is that either winding 13 or 14 can be selected for a relatively high or good output at high engine speeds and the other winding selected for good output at low engine speeds. This will provide a relatively flat capacitor voltage curve versus engine speed. Each winding is associated with its own charging rectifiers thereby reducing the impedence of the charging circuit particularly for the winding designed for good output at high engine speeds.

Applicants have found that the present invention provides the necessary energy for reliable low speed running and starting of an engine while maintaining sufficient energy for high speed operation. The use of a common switching means 18 and the diode steering networks to provide alternate control of the firing circuits minimizes the initial cost while maintaining reliable circuit operation. Further, the use of the common rotating magnet for providing energy to the charging coils as well as to the triggering coils not only results in a relatively inexpensive construction but further provides an apparatus which can be particularly adapted to small engines where it is desired to maintain a relatively low profile. The combined trigger coil and throttle elements maintain accurate trigger signal timing for direct retard and advance firing and thereby maintains a highly desired firing characteristic.

Figure 8:
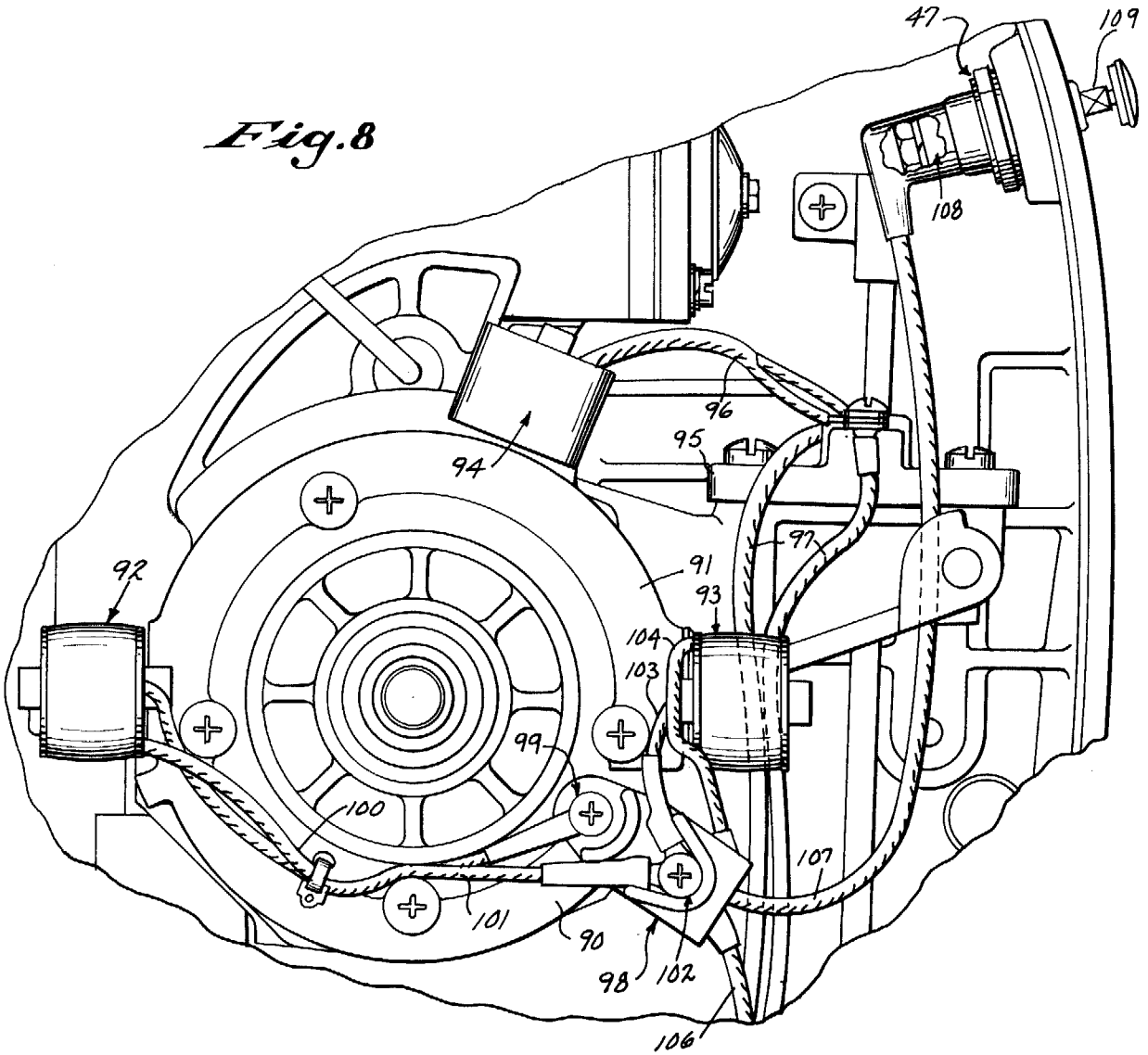

From the previously illustrated embodiment the several leads from the charging and trigger coils terminate on a common terminal board for interconnection to the switch box. An alternative contruction is illustrated in FIGS. 8 and 9. The charging and trigger coils are essentially constructed as previously described, and mounted in the same manner. Thus, the further embodiment illustrated includes a stator mounting plate 90 which is attached to the engine end cap with the generally U-shaped stator 92 by suitable lock screws or the like. The U-shaped core 91 supports the oppositely located charging windings 92 and 93. A trigger winding unit 94 is similarly mounted adjacent the core 91 for angular orientation with respect thereto. The further embodiment is particularly directed to the termination of the leads on the stator as follows. A terminal block 95 is secured to and carried by the mounting plate 90. The trigger coil leads 96 from the trigger unit 94 and the interconnected leads 97 from the switch box unit are terminated on the mounting block 95 to provide the circuit connection such as shown in FIG. 2.

The charging coil units 92 and 93 are terminated and connected into the circuit through a separate terminal unit 98 which is secured to the end cap with the mounting plate 90 as by a mounting screw 99. The mounting unit 98 is generally formed of a suitable insulating material and is formed with a flange mounting portion through which the mounting screw 99 passes and threads into the end cap. The ground lead from the winding or coil 92 is connected as by lead 100 to the mounting screw 99 and thus provides a ground connection for the coil 92. The opposite end of the coil 92 is connected by lead 101 to an interconnecting contact post or screw 102 on the upper wall of the connecting unit 98. A similar lead 103 of coil 93 also terminates on the binding post or screw 102 to provide the common connection between the coils 92 and 93 similar to the schematic illustration of coils 13 and 14 in FIG. 2. The opposite end of the coil 93 is connected via the lead 104 to a post or screw 105 provided on the front wall of the connecting unit 98 as most clearly illustrated in FIG. 9. The output power connecting lead 106 which is connected via the steering diodes, for example, 19 and 20 of FIG. 2, to charge the capacitors is connected to the lead 104 via the terminal 105. A lead 107 connects this same common terminal to a kill button switch unit 108 for switch 47 mounted as a part of the lower cowl unit and provided with an exterior kill button actuator 109. The kill switch unit 8 provides for grounding of the power lead 106 in the same manner as that schematically illustrated in FIG. 2. The illustrated mounting provides a convenient compact termination of the coil assembly and thus contributes to the overall practical application of the present invention to outboard motors and the like.

In summary, the present invention provides a breakerless capacitor discharge ignition system for a two cylinder two cycle alternate firing engine which is of a relatively low cost and highly reliable design and which minimizes the required vertical space requirements.

Various modes of carrying out the invention are contemplated as being within the scope of the following claims, particularly pointing out and distinctly claiming the subject matter which is regarded as the invention.

I claim:

1. A capacitor discharge ignition system for a multiple cylinder internal combustion engine comprising a charging circuit connection means providing time spaced opposite polarity signals between a pair of terminal means, a first capacitor means selectively connected to the charging circuit connection means across said terminal means and charged in response to a first polarity signal, a second capacitor means connected to the charging circuit connection means across said terminal means and charged in response to an opposite polarity signal, first and second individual discharge circuit means connected across each of said capacitor means, and a common discharge control switch means connected as a common conducting part of both of said discharge circuit means for discharge of the corresponding capacitors and including diode network means connected between opposite sides of the control switch means and capacitor means and establishing individually operable discharge circuits for each of said capacitor means in series with said switch means, and maintaining isolation of the charging circuit means and of the discharging circuit means.

2. The capacitor discharge ignition system of claim 1 for a two cylinder, two cycle internal combustion engine having an alternator having a charging winding means establishing first and second polarity signals by 180 electrical degrees, a trigger winding means mounted in circumferential spaced, coplanar relation to said charging winding means, and said common discharge control switch means including a gated switch means having a gate means connected to said trigger winding means.

3. The capacitor discharge ignition system of claim 2 wherein each capacitor is connected across the charging winding means in series with blocking diode means, said discharge circuit means for each of said capacitors including the gated switch means and an isolating diode means, said diodes being polarized to prevent by-pass of the charging circuits.

4. The capacitor discharge ignition of claim 2 wherein the connection of the gate means to said trigger winding includes a rectifying means connected in series with a stabilizing network, said stabilizing network including a capacitor and a resistor in parallel to provide a stabilizing voltage related to the engine speed.

5. The capacitor discharge ignition system of claim 1 for a two cylinder engine, and including a charging alternator having a fixed stator with a pair of coplanar charging windings spaced by 180° and a trigger winding located intermediate said windings and having a rotor with a pair of circumferential pole members defining a pair of neutral zones spaced by 180°, said charging windings being wound to produce correspondingly polarized pulse signals in response to passage of each neutral zone, said charging circuit means including a first diode connected in series with the windings across the first capacitor and a second diode connected in series with the windings across the second capacitor, said diodes being polarized to conduct opposite polarity pulses of the windings, said common control switch means including a gated switch means having a gate to turn-on said switch means and continuing to conduct until the current decreases below a holding current level, a first transformer, a third diode means connected in series with said first capacitor and first transformer and said gated switch means, a second transformer, a fourth diode means connected in series with said second capacitor and second transformer and said gated switch means, with said third and fourth diode means being connected to the opposite sides of the gated switch means and to said capacitors.

6. The capacitor discharge ignition system of claim 1 for a two cylinder engine, and including a charging alternator having a fixed stator with a pair of coplanar charging windings spaced by 180° and a trigger winding located intermediate said windings and having a rotor with a pair of circumferential pole members defining a pair of neutral zones spaced by 180°, said charging windings being wound to produce correspondingly polarized pulse signals in response to passage of each neutral zone, said charging circuit means including a first pair of oppositely polarized diodes means connected between the first charging winding and each of said capacitors to alternately charge the capacitors, a second pair of oppositely polarized diode means connected between the second charging winding and the capacitors to alternately charge the capacitors, each capacitor being simultaneously charged from both windings, said windings being constructed such that one winding produces a good output at relatively high speed and the other winding produces a good output at relatively low speed to produce a relative constant charging of the capacitor with varying speed, said common control switch means including a gated switch means having a gate to turn-on said switch means and continuing to conduct until the current decreases below a holding current level, a a first transformer, a third diode means connected in series with said first capacitor and first transformer and said gated switch means, a second transformer, a fourth diode means connected in series with said second capacitor and second transformer and said gated switch means, and said third and fourth diode means being connected to the opposite sides of the gated switch means and to said capacitors.

7. The capacitor discharge system of claim 1 including an on-off switch means connected to prevent charging of the capacitors.

8. The capacitor discharge ignition system of claim 1 wherein the connection of the trigger winding to the gate means includes a full wave rectifying means, a second gated switch having a gate means connected by a speed stabilizing network to the output of said full wave rectifying means, said stabilizing network including a capacitor and a resistor in parallel, a trigger capacitor connected to said charging means, and said second gated means being connected to activate said first gated switch means by discharging of the trigger capacitor.

9. The capacitor discharge ignition system of claim 1 wherein said control switch means includes a gated switch means and having an alternator with an annular rotor and an adjustable stator, said rotor having a pair of circumferentially extended and radially polarized magnetic poles each spanning essentially 180° of the rotor and defining oppositely located essentially neutral pole positions, means coaxially connecting of said rotor to a drive shaft of the engine, said stator being mounted within the rotor and having a laminated pole member spanning essentially 180° and terminating in the opposite ends in a pair of radially outwardly extending pole pieces with the end face thereof spaced slightly from the periphery of the magnet members on the rotor, a trigger coil, a mounting member attached to the stator for angular positioning of the trigger coil within said rotor, said trigger coil being located in the common plane with said charging coils, and advance-retard control means connected to said mounting member.

10. The capacitor discharge ignition system of claim 9 having a throttle coupling member connected to the mounting member and correspondingly positioned therewith to establish a constant predetermined relationship between the engine throttle setting and the generation of the trigger pulse signal to control the advance and retard.

11. The ignition system of claim 9 wherein said engine includes a flywheel member secured to the crankshaft and having an axially extended skirt portion, said rotor being connected to said skirt portion and including a flexible magnetic ferrite strip secured to an iron ring abutting the skirt portion with a single abutting joint.

12. The ignition system of claim 9 wherein said pair of magnetic poles are defined by a ferrite strip wound into a ring member with an abutting joint being polarized in diametrically opposite points on a diameter normal to the diameter through the abutting joint.

* * * * *

UNITED STATES PATENT AND TRADEMARK OFFICE

CERTIFICATE OF CORRECTION

PATENT NO. : 3,937,200

DATED : February 10, 1976

INVENTOR(S) : RICHARD L. SLEDER and ARTHUR O. FITZNER

It is certified that error appears in the above-identified patent and that said Letters Patent are hereby corrected as shown below:

| | | | | |
|---|---|---|---|---|
| Column | 13, | Line | 34, | after "stator" cancel "92" and insert --- 91 ---; |
| Column CLAIM 2 | 14, | Line | 48, | after "signals" insert --- spaced ---; |
| Column CLAIM 9 | 16, | Line | 36, | at the end of the line, cancel "advancere-" and insert --- advance-re- ---; |

Signed and Sealed this

*first* Day of *June 1976*

[SEAL]

*Attest:*

RUTH C. MASON
*Attesting Officer*

C. MARSHALL DANN
*Commissioner of Patents and Trademarks*